United States Patent [19]

Kiyosawa

[11] 4,433,620

[45] Feb. 28, 1984

[54] HYDROPNEUMATIC CONTROL SYSTEM FOR A WHEELED, SELF-PROPELLED BOLSTER FOR THE TRANSPORTATION OF A DIE ASSEMBLY INTO AND OUT OF A PRESS

[75] Inventor: Hiroshi Kiyosawa, Komatsu, Japan

[73] Assignee: Kabushiki Kaisha Komatsu Seisakusho, Tokyo, Japan

[21] Appl. No.: 436,069

[22] Filed: Oct. 22, 1982

[30] Foreign Application Priority Data

Oct. 30, 1981 [JP] Japan ..... 56-172783

[51] Int. Cl.[3] ..... B30B 15/02; B30B 15/06; B30B 15/30

[52] U.S. Cl. ..... 100/43; 72/446; 72/448; 100/99; 100/224; 100/229 R; 100/918

[58] Field of Search ..... 100/43, 48, 99, 224, 100/229 R, 918; 72/446, 448

[56] References Cited

U.S. PATENT DOCUMENTS

| | | | |
|---|---|---|---|
| 3,212,430 | 10/1965 | Clements | 100/43 |
| 3,422,661 | 1/1969 | Blackhurst | 100/224 |
| 3,446,106 | 5/1969 | Ferris et al. | 100/43 |
| 3,862,565 | 1/1975 | Smit | 100/229 R X |
| 3,878,773 | 4/1975 | Smit | 100/918 X |
| 3,935,811 | 2/1976 | Lenz et al. | 100/229 R X |
| 3,986,448 | 10/1976 | Seyfried et al. | 100/918 X |
| 4,206,699 | 6/1980 | Hemmelgarn | 100/918 X |
| 4,258,620 | 3/1981 | Sallander | 100/224 |

*Primary Examiner*—Timothy F. Simone
*Attorney, Agent, or Firm*—Armstrong, Nikaido, Marmelstein & Kubovcik

[57] ABSTRACT

A bolster travels, with a first set of wheels propelled by a first pneumatic motor, along a first pair of rails into and out of a press and, with a second set of wheels propelled by a second pneumatic motor, along a second pair of rails laid at right angles with the first rail pair. The first set of wheels are mounted to the bolster body via hydraulic lift jacks for up-and-down movement into and out of engagement with the rails. The first and second pneumatic motors communicate with a source of air under pressure via first and second pilot-operated selector valves respectively. The lift jacks communicate with a hydraulic pump, driven from the pressurized air source, via a third pilot-operated selector valve. For pilot-operating the first, second and third selector valves there are provided manual control valves and sensors, the latter being actuated automatically to produce pneumatic signals representative of various working conditions of the bolster. The pneumatic output signals of the control valves and the sensors are processed by additional valves and logic devices and applied to the pilot ports of the three selector valves for correctly controlling the travel of the bolster along the first and second pairs of rails. Also provided are indicators, operated pneumatically by the sensors, for visually indicating the operating conditions of the bolster.

9 Claims, 7 Drawing Figures

HYDROPNEUMATIC CONTROL SYSTEM FOR A WHEELED, SELF-PROPELLED BOLSTER FOR THE TRANSPORTATION OF A DIE ASSEMBLY INTO AND OUT OF A PRESS

BACKGROUND OF THE INVENTION

This invention relates to a control system for a mobile, self-propelled holster capable of travelling in orthogonal directions for transporting a die assembly into and out of a press in the act of a change from one die assembly to another.

Mobile dies bolsters are usually propelled either electrically or pneumatically. Either propelling method has its own advantages and disadvantages. The electrical propelling method is the more widely accepted by virtue of the ease of automation. A problem arises, however, as the die bolsters have recently been equipped with die lifters and lower-die clamps with a view to the automation of, and the curtailment of the period for, the procedure preparatory to actual pressing operation. The use of hydraulic pressure is preferred for operating the die lifters and lower-die clamps becauuse of the less space requirement of the hydraulic power system. In electrically propelled die bolsters, however, the hydraulic power system demands an additional electric motor as well as solenoid valves for its operation. Consequently the power cables for feeding the electrical equipment on the die bolsters must be of special construction and so lack universality.

An additional drawback of the electrically propelled die bolsters also concerns the power cables, which are required to carry current at a voltage ranging from 200 up to 400 volts. Should they be accidentally broken or otherwise impaired, therefore, the consequences can be serious.

The above problems are absent from pneumatically driven die bolsters, but a different set of problems manifest themselves. One of these is that their control systems have not been sufficiently safeguarded against operating errors. The operator has had to rely on his own skill in manipulating the controls. These controls have been placed on the bolster itself, moreover, so that the operator has been in constant exposure to danger as he operates them.

SUMMARY OF THE INVENTION

The present invention provides an improved hydropneumatic control system for a self-propelled die bolster in order to avoid the noted problems attendant upon electrical systems. The hydropneumatic control system according to the invention incorporates safeguards against errors in operating the bolster. Further the invention also eliminates hazard to the operator by making possible the remote control of the bolster.

Summarized briefly, the hydropneumatic control system according to the invention is intended for a mobile bolster of the type having a first set of wheels for travelling along a first track into and out of a press, and a second set of wheels for travelling along a second track right-angularly crossing the first track. Either of the first and second set of wheels are mounted to the bolster body via hydraulic lift jack means for up-and-down movement into and out of engagement with the tracks. The bolster has also a positioning pin normally held in a raised position on the bolster body and moved down to a depressed position at the intersection of the first and second tracks in order to position the bolster thereon.

The hydropneumatic control system for the mobile bolster of the above described type comprises first and second pneumatic motors coupled in driving relationship to at least some of the first set of wheels and to at least some of the second set of wheels for moving the bolster back and forth along the first and second tracks, respectively. First and second pilot-operated selector valves control communication between a source of air under pressure and the first and second pneumatic motors respectively. A third selector valve controls communication between a source of hydraulic fluid under pressure and the hydraulic lift jack means. The first, second and third selector valves are under the control of control valve means which put out pneumatic signals on manual actuation. Pneumatic signals are also produced by sensor means actuated automatically, the pneumatic output signals of the sensor means being indicative of whether or not the bolster lies in position in the press, whether the hydraulic lift jack means are extended or contracted 8.e., which of the two set of wheels are engaged with the track), and whether the positioning pin is in the raised or depressed position (i.e., whether or not the bolster is correctly positioned on the crossing of the first and second tracks). In response to these output signals of the control valve means and the sensor means, signal processing means apply pilot signals to the three selector valves only when the control valve means are operated properly. Also included are indicator means for indicating the operating conditions of the bolster in response to at least the output signals of the sensor means.

Thus the invention employs the pneumatic motors, controlled purely pneumatically, for propelling the bolster along the two intersecting tracks. Although hydraulic means are adopted for the changeover between the two sets of bolster wheels, the source of hydraulic pressure for such means can be driven from the same compressed air source as are the pneumatic motors.

It will be appreciated that the hydropneumatic control system according to the invention is amply safeguarded against operating errors. As the operator manipulates the control valve means for operating the bolster, the signal processing means compare the output signals of the control valve means withh those of the sensor means and actuate the selector valves only when the control valve means are operated properly in light of the positions and conditions of the bolster as represented by the sensor output signals. Further the indicator means indicate, perhaps visually, the working conditions of the bolster in order to help the operator correctly activate the control valve means.

According to an additional feature of the invention the control valve means are mounted external to the bolster to enable the operator to remotely control the bolster. The remote control of the bolster is preferred because of the reduced hazard to the operator.

The above and other features and advantages of this invention and the manner of attaining them will become more apparent, and the invention itself will best be understood, from a study of the following description of a preferred embodiment taken in conjunction with the attached drawings.

DESCRIPTION OF THE PREFERRED EMBODIMENT

Figure 1:
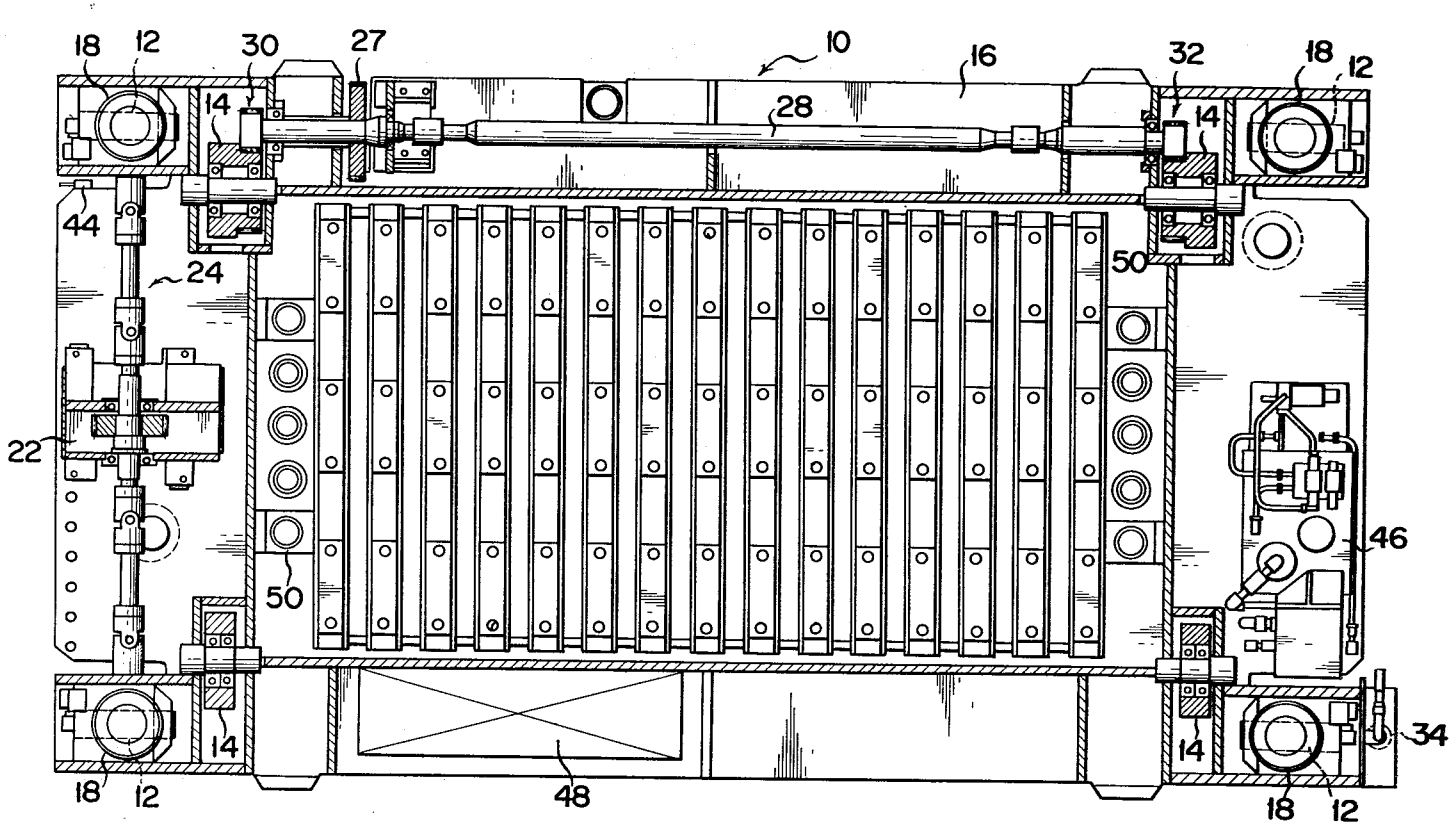
FIG. 1 is a horizontal section through a typical mobile bolster to be controlled hydropneumatically in accordance with the principles of this invention.
Figure 2:
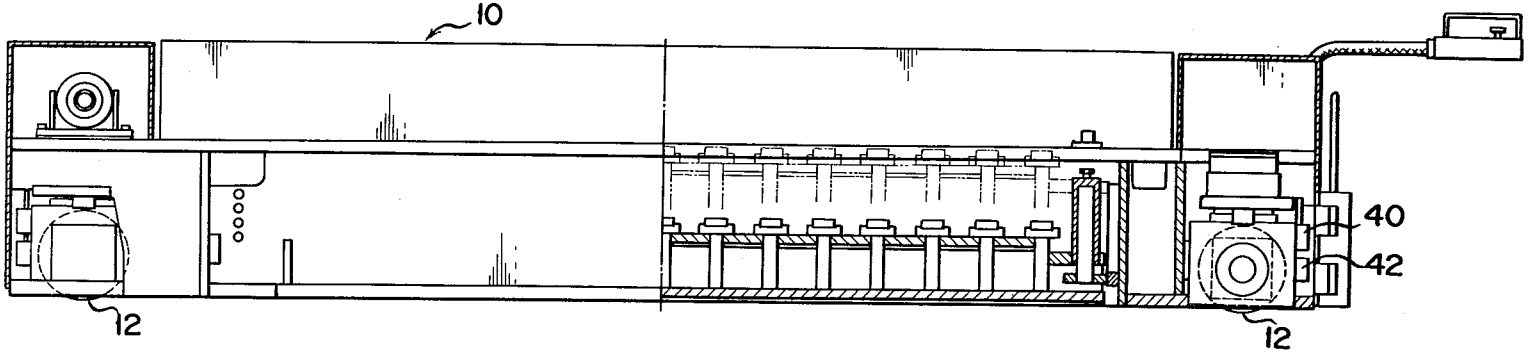
FIG. 2 is a side elevation, partly sectioned for clarity, of the mobile bolster as seen from the lower side of FIG. 1.
Figure 3:
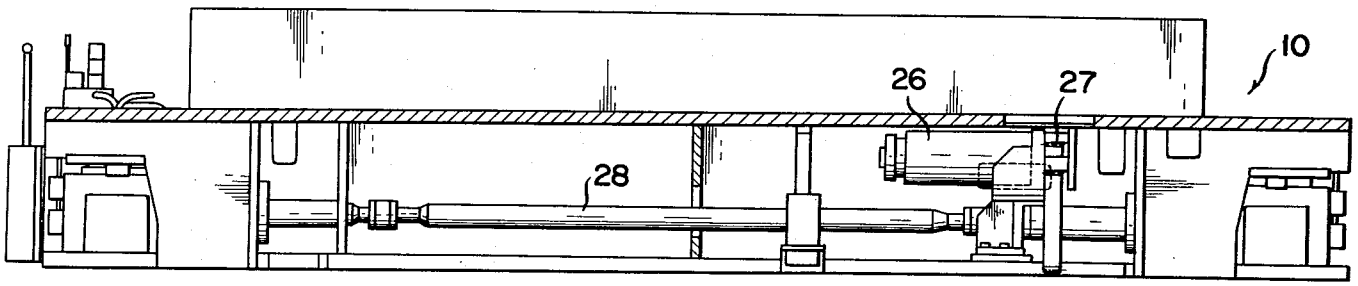
FIG. 3 is also a side elevation, partly sectioned for clarity, of the mobile bolster as seen from the upper side of FIG. 1.

Reference is first directed to FIGS. 1 to 5 in order to explain the construuction of the self-propelled die bolster to be controlled by the hydropneumatic control system of this invention. Generally designated 10, the bolster has a first set of four wheels 12 for travelling along a first linear track and a second set of four wheels 14 for travelling along a second linear track right-angularly crossing the first track. The first 12 and second 14 sets of wheels are of course oriented at right angles with each other. The two intersecting tracks will be later described in conjunction with FIG. 6.

It will be observed from FIG. 1 that the bolster 10 as a whole is elongated in the right-to-left direction as viewed in the drawing. Thus the bolster can be thought of as travelling endwise with the first set of wheels 12, and sidewise with the second set of wheels 14.

Figure 4:
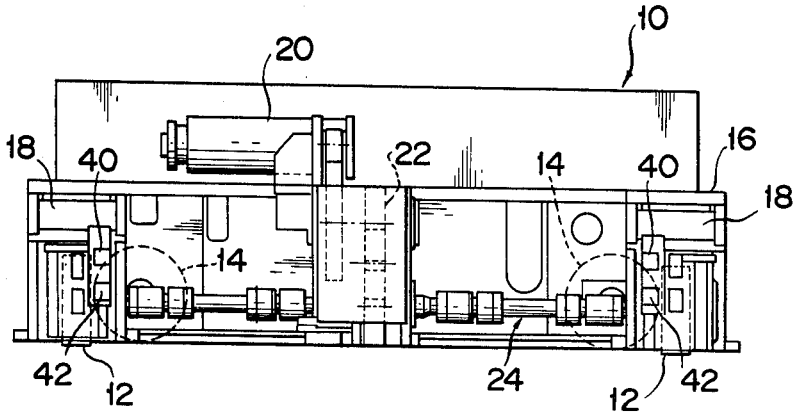
FIG. 4 is a left hand end elevation of the mobile bolster of FIG. 1.

Perhaps as best revealed in FIG. 4, the first set of wheels 12 are mounted to the body 16 of the bolster via hydraulic lift jacks 18 for up-and-down movement relative to the bolster body past the second set of wheels 14. With the extension of these lift jacks, therefore, the first set of wheels 12 move into rolling engagement with the first track. The contraction of the lift jacks results in the retraction of the first set of wheels, with the consequent engagement of the second set of wheels 14 with the second track. Notwithstanding the showings of the drawings, however, the first set of wheels 12 need not necessarily be mounted to the lift jacks, it being only required that either of the two sets of wheels be movable up and down relative to the other.

At 20 in FIG. 4 is seen a bidirectional pneumatic motor for propelling the bolster 10 endwise along the first track. The motor 20, hereinafter referred to as the endwise drive motor, is coupled in driving relationship to the two wheels (seep at the left hand end in FIg. 1) of the first set of wheels 12 via a gear train 22 and a drive shaft assembly 24 with universal couplings. Another bidirectional pneumatic motor, hereinafter referred to as the sidewise drive motor, is seen at 26 in FIG. 3. The sidewise drive motor 26 is geared at 27 to a drive shaft 28 which, as better illustrated in FIG. 1, is geared at 30 and 32 to the two wheels (shown at the top in FIG. 1) of the second set of wheels 14.

Figure 5:
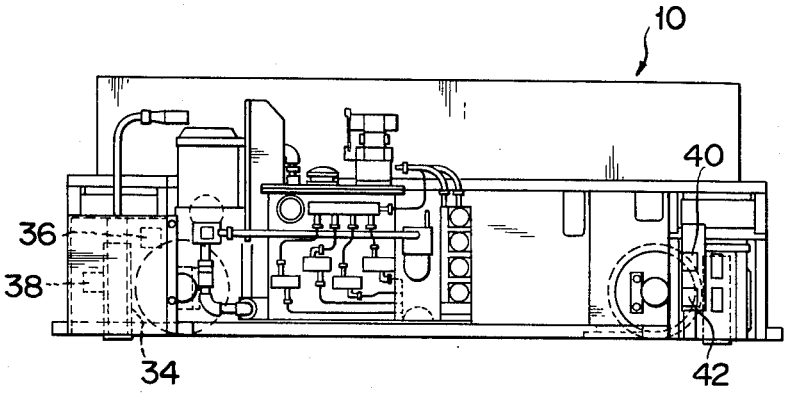
FIG. 5 is a right hand end elevation of the mobile bolster of FIG. 1.

FIGS. 1 and 5 show at 34 an upright positioning pin normally held raised and out of contact with the floor. As the bolster 10 reaches the intersection of the first and second tracks, the positioning pin 34 is to be depressed and engaged in a hole created in the floor, thereby positioning the bolster on the track intersection and making possible its transfer from one track to the other. FIG. 5 also shows a pneumatic "up" sensor valve 36 and "down" sensor valve 38 lying in the immediate vicinity of the positioning pin 34. The positioning pin actuates, and holds actuated, the "up" sensor valve 36 when in the raised position, and the "down" sensor valve 38 when in the depressed position at the track intersection.

The four hydraulic lift jacks 18 for switching between the two sets of wheels 12 and 14 are also each provided with a pneumatic "extend" sensor valve 40 and "contract" sensor valve 42. The lift jacks actuate, and hold actuated, the extend sensor valves 40 when extended, that is when the first set of wheels 12 are moved into engagement with the first track. On contraction of the lift jacks 18, with the consequent engagement of the second set of wheels 14 with the second track, the contract sensor valves 42 become actuated and are held actuated pending the re-extension to the lift jacks. As will be seen from the subsequent description of the hydropneumatic control system, only one extend sensor valve and only one contract sensor valve could be used for all the lift jacks 18, even though the use of the two sensor valves for each lift jack as in the illustrated embodiment is recommended.

A further pneumatic sensor valve is provided at 44 in FIG. 1. This sensor valve becomes actuated when the bolster 10 reaches a preassigned working position in the press, and is held actuated as long as the bolster stays in that position, so that it will hereinafter be referred to as the bolster position sensor.

FIG. 1 reveals some additional components more or less pertinent to the hydropneumatic control system of this invention. They are: (1) a hydraulic power package 46; (2) an assemblage 48 of pneumatic valves, logic devices, etc., hereinafter set forth; and (3) a set of four die lifters 50.

Figure 6:
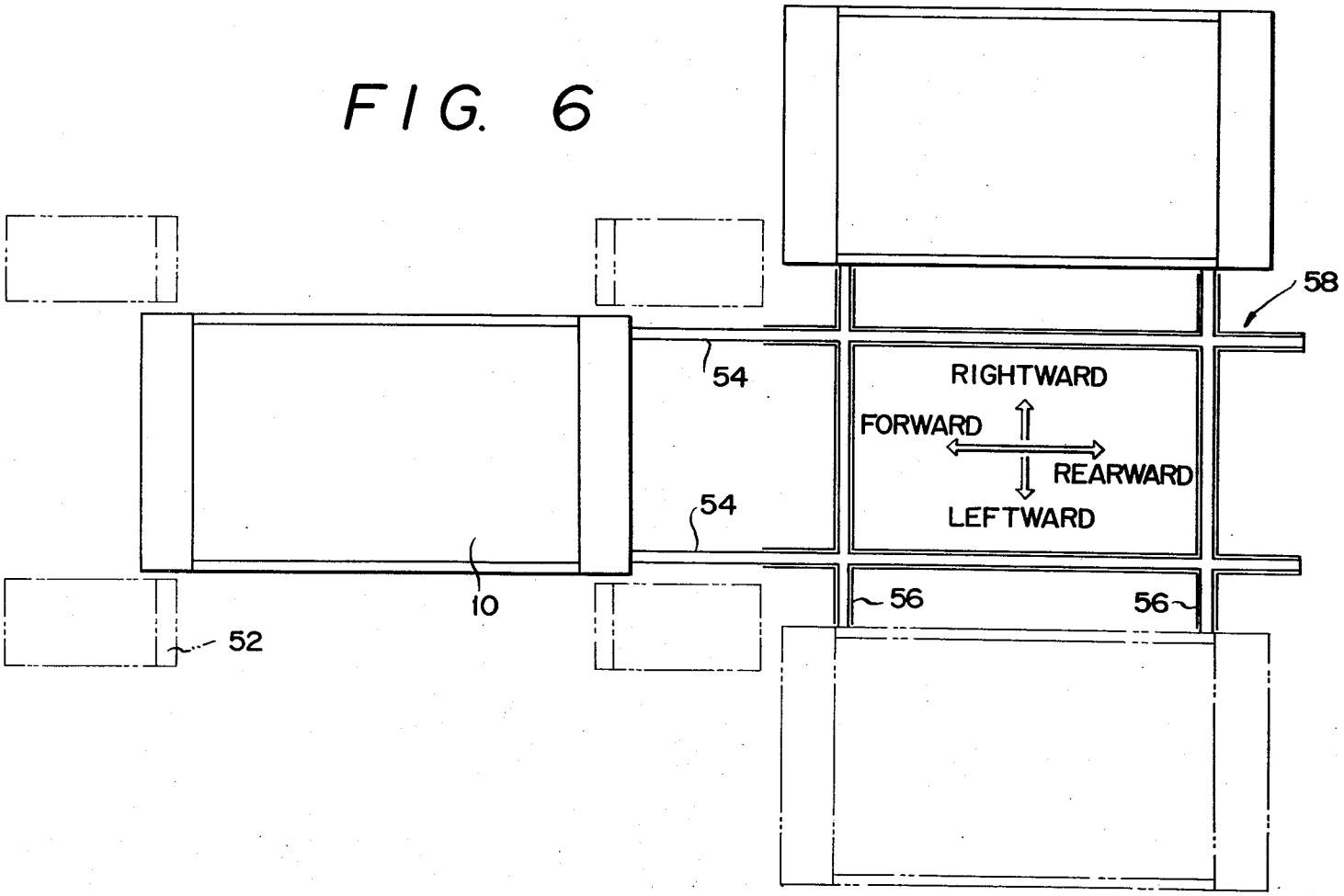
FIG. 6 is a plan explanatory of the way in which the mobile bolster travels along two orthogonal tracks for transporting a die assembly into and out of a press.

With reference to FIG. 6 it will be observed that the bolster 10 travels into and out of a press 52 along a first pair of rails 54 forming the aforesaid first track. The second track, then, is formed by a second pair of rails 56 laid at right angles with the first rail pair 54. The bolster has the first set of wheels 12 in engagement with the first rail pair 54 while travelling endwise thereon. Reaching the intersection 58 of the two rail pairs, the bolster has the first set of wheels retracted. Thereupon the second set of wheels 14 come into engagement with the second rail pair 56, making it possible for the bolster to roll sidewise thereon in either direction.

For convenience in description the terms indicating the travelling directions of the bolster 10 wiil be used in the senses indicated in FIG. 6. Namely, the terms "forward," "rearward" and derivatives thereof will have reference to the leftward and rightward extremities, respectively, of the first rail pair 54 as appearing in FIG. 6. The terms "rightward," "leftward" and derivatives thereof will have reference to the upper and lower extremities, respectively, of the second rail pair 56 as seen in FIG. 6.

Figure 7:
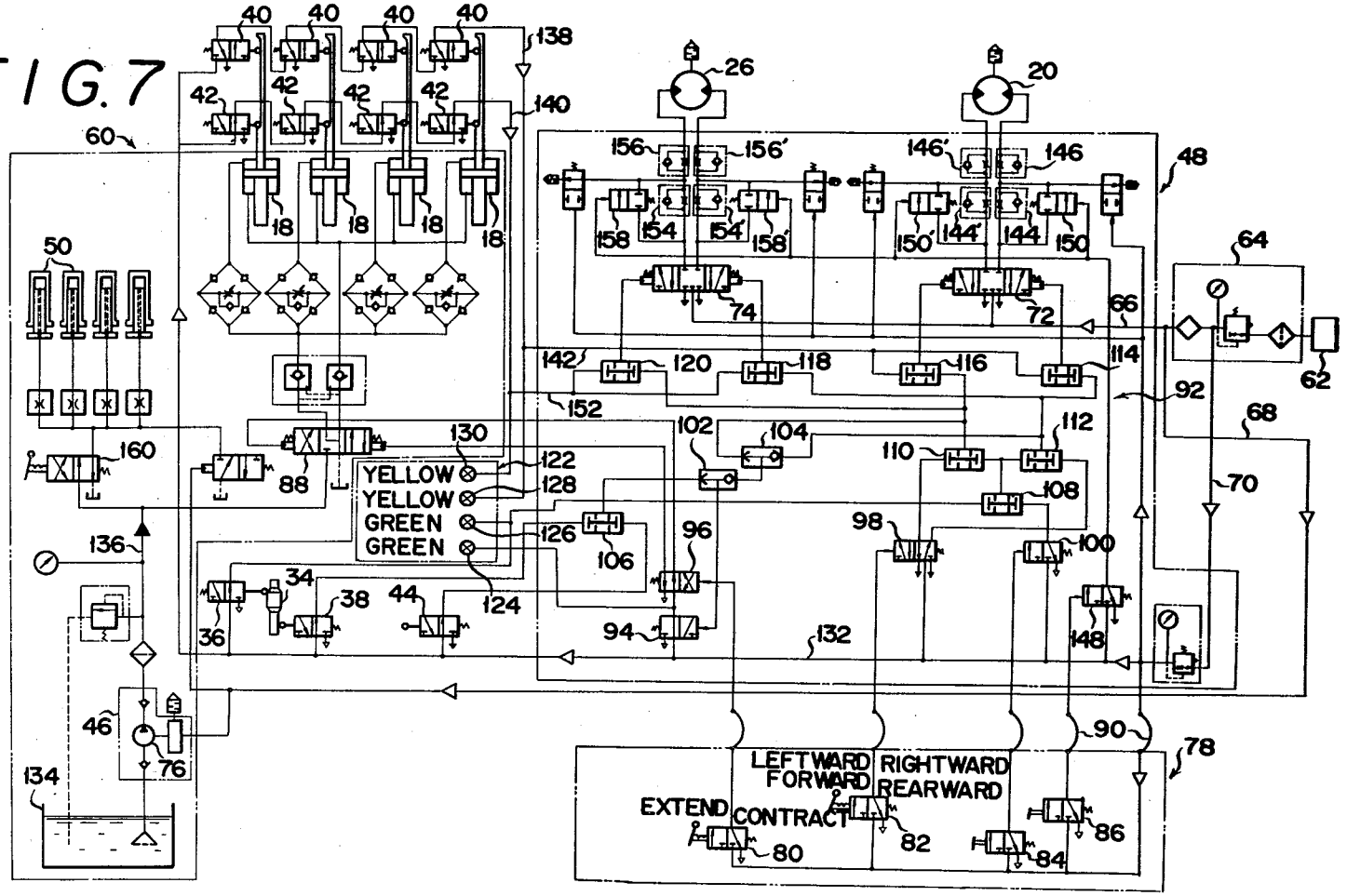
FIG. 7 is a schematic diagram of the hydropneumatic control system for controlling the mobile bolster in accordance with the principles of the invention.

FIG. 7 diagrammatically represents the complete hydropneumatic control system for the self-propelled die bolster 10 explained hereinbefore. The parts shown enclosed in the dot-and-dash outline generally referenced 60 constitute a hydraulic circuit. All the other parts of the illustrated system operate pneumatically. Of the pneumatically operating parts, those shown enclosed in another dot-and-dash outline designated 48 are installed as a unit on the bolster at 48 in FIG. 1.

The pneumatic circuit of the hydropneumatic control system has a source 62 of air under pressure supplying pressurized air via an output unit 64 having first 66, second 68 and third 70 supply lines extending therefrom. The first supply line 66 leads to the endwise drive motor 20 via a pilot-operated forward/rearward selector valve 72, and to the sidewise drive motor 26 via a rightward/leftward selector valve 74. Branching off from the first supply line 66, the second supply line 68 leads to the hydraulic power package 46 of the hydraulic circuit 60 for driving the pump 76 therein.

The third supply line 70 leads to control valve means 78 to be actuated manually by the bolster operator. In this particular embodiment the control valve means 78 comprisse a wheel-change control valve 80, a direction control valve 82, a slow travel valve 84, and a fast travel valve 86. The wheel-change control valve 80 is intended to pilot-operate an extend/contract selector valve 88 of the hydraulic circuit 60 which controls communication between the pump 76 and the lift jacks 18 carrying the first set of wheels. The direction control valve 82 and the slow travel valve 84 are both intended to pilot-operate the forward/rearward selector valve 72 and the rightward/leftward selector valve 74. The fast travel valve 84 is intended to make faster the travelling speed of the bolster along the first and second tracks.

The control valves 80, 82, 84 and 86 are all mounted external to the bolster, as on a fixed control console, not shown, for the safety of the operator. Flexible conduits 90 are used for communicating the control valves with pertinent parts of the pneumatic circuit on the mobile bolster.

Interposed between the three control valves 80, 82 and 84 and the three selector valves 72, 74 and 88 are signal processing means, generally labelled 92, comprising selector valves 94, 96, 98 and 100, OR devices 102 and 104, and AND devices 106, 108, 110, 112, 114, 116, 118 and 120. The signal processing means 92 receive not only the pneumatic output signals of the control valves 80, 82 and 84 but also those of the "up" sensor valve 36, "down" sensor valve 38, extend sensor valves 40, contract sensor valves 42, and bolster position sensor valve 44. (All these sensor valves will hereinafter be called sensors for simplicity.) In response to these control valve and sensor output signals the signal processing means apply pilot signals to the selector valves 72,, 74 and 88 only when the control valves 80, 82 and 84 are operated properly.

Generally identified by the reference numeral 122 are indicator means operated pneumatically from the sensors 36, 38, 40, 42 and 44, as well as from the signal processing means 92, for visually indicating the operating conditions of the bolster. In the illustrated embodiment the indicator means 122 include a wheel-change indicator 124, a travel indicator 126, an extend indicator 128, and a contract indicator 130. Operated from the "down" sensor 38 and bolster position sensor 44, the wheel-change indicator 124 turns green when the bolster is in condition for a changeover from one set of wheels to the other by the extension or contraction of the lift jacks 18. The travel indicator 126 is operated from the "up" sensor 36, also turning green when the bolster is in condition for travelling along the first or second track. The extend indicator 128 is operated from the extend sensors 40 and turns yellow upon extension of the lift jacks. The contract indicator 130 is operated from the contract sensors 42 and turns yellow upon contraction of the lift jacks.

Further details as to the configuration of the hydropneumatic control system of FIG. 7 will become apparent from the following description of operation. The operational description presupposes that the bolster 10 with the unshown die assembly thereon is now located in position in the press 52, as in FIG. 6, and is to be moved rearwardly along the first pair of rails 54 and then leftwardly along the second pair of rails 56, for the change of the die assembly with a different one on another mobile bolster. The withdrawal of the bolster from the press takes place through the following procedure discussed under pertinent headings.

ENGAGEMENT OF THE FIRST WHEEL SET WITH THE FIRST TRACK

The extend/contract selector valve 88 has been in neutral as the pressurized air source 62 has been out of operation during the stay of the bolster in the press. The lift jacks 18 must therefore be extended to raise the bolster body 16 together with the second set of wheels 14 in order that the bolster body may stand on onlyy the first set of wheels 12 in engagement with the first pair of rails 54. To this end, with the pressurized air source 62 set into operation, the wheel-change control valve 80 is manually actuated to its extend position. Thereupon the pressurized air from the supply line 70 flows through the wheel-change control valve 80 to the pilot port of the selector valve 96 thereby shifting same to the offset position against the bias of the spring.

Interposed between the inlet port of the selector valve 96 and a supply line 132, in communication with the supply line 70, is the selector valve 94 which is pilot operated from the "down" sensor 38 and the bolster position sensor 44 via the AND device 106 and the OR device 102. Since the positioning pin 34 is now in the raised position, as drawn, the "down" sensor 38 is unactuated, directing the pressurized air from the supply line 132 to one of the two inputs of the AND device 106. The bolster position sensor 44, however, is now actuated, blocking the air from the supply line 132 and exhausting the other input of the AND device 106. As is well known, the output from an AND device assumes the 1-state if, and only if, all of the inputs assume the 1-state. Accordingly the AND device 106 now delivers no pilot signal to the selector valve 94 via the OR device 102, so that the selector valve 94 remains in the normal, open position as shown.

Thus the pressurized air from the supply line 132 flows through the selector valves 94 and 96 (the latter in the offset position) to one of the two pilot ports of the extend/contract selector valve 88 thereby shifting same to the left. The output from the selector valve 94 is also directed to the wheel-change indicator 124, which thereupon turns green.

Driven pneumatically from the pressurized air source 62, the hydraulic pump 76 is now drawing the hydraulic fluid from a reservoir 134 and forcing it out into a hydraulic supply line 136 leading to the extend/contract selector valve 88. Since this valve is now in the right hand offset position as stated above, the pressurized hydraulic fluidd flows therethrough into the extend chambers of the lift jacks 18. The extension of these lift jacks results in the lifting of the bolster body 16 together with the second set of wheels 14, so that the bolster body stands on the first set of wheels 12 in engagement with the first pair of rails 54.

Also, upon extension of the lift jacks 18, the extend sensors 40 are all thereby actuated to their open positions against the forces of the springs. In their open positions the extend sensors communicate the supply line 132 with a line 138 leading to the extend indicator 128. Consequently this indicator turns yellow.

PREPARATION FOR REARWARD TRAVEL

The operator may proceed to set the direction control valve 82 in the normal posiition, as shown, by way of further preparation for rearward travel of the bolster along the first track. The direction control valve 82 when in the normal position applies no pilot pressure to the selector valve 98, allowing same to remain in the normal position. The selector valve 98 when in the normal position directs the pressurized air from the supply line 132 to one of the two inputs of the AND device 112. The other input of this AND device is not yet pressurized, so that it produces no output pressure. The bolster is not yet started.

The positioning pin 34 is now in the raised position as aforesaid, actuuating the "up" sensor 36 to its open position against the force of the spring. Thus the pressurized air from the supply conduit 132 flows through the "up" sensor 36 to the travel indicator 126 thereby turning same green.

LOW-SPEED REARWARD TRAVEL

After making sure that the travel indicator 126 is green, and the extend indicator 128 yellow, the operator may actuate the slow travel valve 84 to its open position for setting the bolster in rearward travel at low speed. Thus pilot-operated from the slow travel valve 84, the selector valve 100 allows the pressurized air from the supply line 132 to flow into the AND device 108 through one of its two inputs. The other input of this AND device is also pressurized from the "up" sensor 36, so that it delivers the pressurized air to one of the two inputs of the AND device 112, as well as of the AND device 110. The latter device produces no output pressure, however, as its other input is now not pressurized from the selector valve 98. The AND device 112 does produce an output pressure as its two inputs are both pressurized.

The output from the AND device 112 is directed to one of the two inputs of the AND device 114, as well as of the AND device 118. The other input of the latter AND device 118 is now not pressurized from the contract sensors 42 via a line 140. The other input of the former AND device 114 is being pressurized from the extend sensors 40 via the line 138 and a line 142 branching off therefrom. Thus only the AND device 114 delivers a pilot pressure signal to the forward/rearward selector valve 72 thereby causing same to shift to the left.

Thereupon the forward/rearward selector valve 72 directs the pressurized air from the supply line 66 toward one of the air inlets of the endwise drive motor 20 via two successive restrictor means 144 and 146. The endwise drive motor is thus set into rotation in a direction to cause rearward travel of the bolster. Having traversed the two restrictor means 144 and 146, the air admitted into the endwise drive motor has a relatively low pressure, so that the bolster starts travelling slowly toward the track intersection 58 of FIG. 6.

It will be noted that the output from the AND device 112 is also directed to one of the inputs of the OR device 102 via the OR device 104. The other input of the OR device 102 is connected to the AND device 106 and thence to the "down" sensor 38 and the bolster position sensor 44. The bolster position sensor returns to the normal position as the bolster starts moving out of the press, so that the AND device 106 also delivers the pressurized air to the OR device 102. With both of its inputs thus pressurized, the OR device 102 delivers a pilot pressure to the selector valve 94 thereby shifting same to the offset position against the bias of the spring. Thereupon the wheel-change indicator 124 turns off and remains off until the bolster reaches the track intersection.

SPEEDUP

The illustrated embodiment has provisions for driving the bolster at a higher speed after the slow start. To this end the operator may actuate the fast travel valve 86 to its offset position thereby causing same to apply a pilot signal to a selector valve 148. Thus pilot-operated, the selector valve 148 places the supply line 132 in communication with the pilot port of an on-off valve 150 connected in parallel relation with the restrictor means 144. Normally held closed by the force of a spring, the on-off valve 150 is opened by the selector valve 148 upon manual activation of the fast travel valve 86 to the offset position. Thereupon the pressurized air from the forward/rearward selector valve 72 bypasses the restrictor means 144 and passes only the other restrictor means 146 before entering the endwise drive motor 20. The increased pressure of the incoming air makes it possible for the motor to propel the bolster at correspondingly higher speed.

SLOWDOWN

The bolster should be slowed down as it approaches the track intersection, by again operating the fast travel valve 86 back to its normal position. With the on-off valve 150 thus reclosed via the selector valve 148, the pressurized air from the forward/rearward selector valve 72 again starts flowing through the two restrictor means 144 and 146. The travelling speed of the bolster is thus reduced.

At the track intersection the operator may return the slow travel valve 84 to its normal position. Then, no longer supplied with the pilot pressure from the AND device 114, the forward/rearward selector valve 72 is sprung back to its closed center position, thus setting the endwise drive motor 20 out of operation.

BOLSTER POSITIONING AT THE TRACK INTERSECTION

After the bolster 10 has come to a temporary stop at the crossing 58 of the first 54 and second 56 pairs of rails, the positioning pin 34 is depressed into the unshown bore created in the floor. The positioning pin will not be received in the bore unless the bolster lies in position on the track intersection. The depression of the positioning pin results in the spring return of the "up" sensor 36 to the normal, closed position and in the actuation of the "down" sensor 38 to the offset, closed position against the force of the spring. The "up" sensor 36 when returned to the normal position vents the travel indicator 126 thereby turning same off.

The "down" sensor 38, on the other hand, vents one of the inputs of the AND device 106 when actuated to the offset position. Consequently, even though the bolster position sensor 44 remains open, the AND device no longer delivers pressurized air to one of the inputs off the OR device 102. The other input of this OR device also no longer receives pressurized air from the AND device 112. Thus the selector valve 94 is spring returned to the open position thereby pressurizing the wheel-change indicator 124 and so turning same green.

CHANGEOVER FROM FIRST TO SECOND SET OF WHEELS

Making certain that the wheel-change indicator 124 has turned green, the operator may shift the wheel-change control valve 80 to the contract position for the retraction of the first set of wheels 12 and the consequent engagement of the second set of wheels 14 with the second pair of rails 56. The wheel-change control valve when in the contract position exhausts the pilot port of the selector valve 96, allowing same to be sprung back to the normal position. Since the selector valve 94 is now also in the normal position, the pressurized air from the supply line 132 actuates the extend-/contract selector valve 88 to the right.

Thus actuated, the extend/contract selector valve 88 places the pump 75 in communication with the contract chambers of the lift jacks 18. Upon full contraction of the lift jacks, with the resulting engagement of the second set of wheels 14 with the second pair of rails 56, the four contract sensors 42 are all actuated to their open positions against the forces of the springs. The opened contract sensors direct the pressurized air from the supply line 132 toward the contract indicator 130 by way of the line 140, whereupon the contract indicator turns yellow.

PREPARATIONS FOR LEFTWARD TRAVEL

Immediately following the contraction of the lift jacks 18 the positioning pin 34 may be withdrawn out of the bore in the floor. The "up" sensor 36 becomes open upon return of the positioning pin to the raised position and so causes the travel indicator 126 to turn green. The "down" sensor 38 also becomes open, whereas the bolster position sensor 44 has been open. Having both of its inputs pressurized by the sensors 38 and 44, the AND device 106 actuates the selector valve 94 to the offset position via the OR device 102. The actuated selector valve 94 turns off the wheel-change indicator 124 and allows the extend/contract selector valve 88 to return to the neutral position.

The operator may actuate the direction control valve 82 to the "leftward" position after confirming that the travel indicator 126 is green, and the contracct indicator 130 yellow. The selector valve 98 is then pilot operated from the direction control valve to shift to its offset position against the force of the spring, thereby directing the pressurized air from the supply line 132 to one of the inputs of the AND device 110. The other input of this AND device is not yet pressurized, however, so that the bolster remains stationary.

LOW-SPEED LEFTWARD TRAVEL

The operator may proceed to open the slow travel valve 84 for setting the bolster in leftward travel along the second pair of rails 56 at low speed. The opened slow travel valve 84 causes the selector valve 100 to pass the pressurized air from the supply line 132 to one of the inputs of the AND device 108. The other input of this AND device is being pressurized from the "up" sensor 36, so that it directs the pressurized air to the aforesaid other input of the AND device 110.

Now the AND device 110 delivers the air pressure to one of the two inputs of the AND device 120, as well as of the AND device 116. The other input of the AND device 116 is now open to atmosphere through one of the extend sensors 40. The other input of the AND device 120 is being pressurized froom the contract sensors 42 via the line 140 and a line 152 branching off therefrom. Thus only the AND device 120 delivers a pilot pressure to the rightward/leftward selector valve 74 thereby shifting same to the right.

Thereupon the rightward/leftward selector valve 74 directs the pressurized air from the supply line 66 toward one of the air inlets of the sidewise drive motor 26 via two successive restrictor means 154 and 156. The sidewise drive motor is thus set into rotation in a direction to cause leftward travel of the bolster. Since the air admitted into the sidewise drive motor at this time has a relatively low pressure, the bolster starts travelling slowly to the left along the second pair of rails 56.

It will be noted that the output from the AND device 110 is also directed to one of the inputs of the OR device 102 via the OR device 104. This input pressure to the OR device 102 coacts with that from the AND device 106 to maintain the selector valve 94 in the offset position against the bias of the spring.

SPEEDUP

For increasing the speed of the bolster during its leftward travel the operator may again actuate the fast travel valve 86 to the open position. Pilot-operated from the fast travel valve, the selector valve 148 directs the pressurized air from the supply conduit 132 to the pilot port of an on-off valve 158 connected in parallel relation with the restrictor means 154. Thereupon the on-off valve 158 opens, causing the pressurized air from the rightward/leftward selector valve 74 to bypass the restrictor means 154 and to pass only the other restrictor means 156 before entering the sidewise drive motor 26. Now the bolster starts travelling faster.

SLOWDOWN

The operator may manipulate the fast travel valve 86 back to its normal position toward the end of the leftward travel of the bolster. The Consequent closure of the on-off valve 158 causes the pressurized air from the rightward/leftward selector valve 74 to flow again through the two restrictor means 154 and 156. Thus the bolster slows down, and comes to a stop as the slow travel valve 84 is shifted back to the normal position.

The operator may proceed to operate a die lifter control valve 160 included in the hydraulic circuit 60. The die lifters 50 are essentially single-acting hydraulic jacks, normally in communication with the fluid drain via the control valve 160. The actuation of this control valve against the force of the spring results in the communication of the die lifters 50 with the pump 76 via the hydraulic supply line 136 and, therefore, in the extension of the die lifters.

Although the operation of the hydropneumatic control system during the return of the bolster into the press is believed to be self-evident from the foregoing description, some explanation will be made to refer to additional parts of the control system appearing in FIG. 7 but not yet mentioned. During the rightward travel of the bolster along the second track at low speed, the rightward/leftward selector valve 74 directs the pressurized air from the supply line 66 toward the sidewise drive motor 26 via successive restrictor means 154' and 156'. Then, as the fast travel valve 86 is actuated, an on-off valve 158' connected in parallel with the restrictor means 154' is pilot operated to open, thus providing a bypass around the restrictor means 154'. Likewise, during the forward travel of the bolster along the first track at low speed, the forward/rearward selector valve 72 supplies the pressurized air to the endwise drive motor 20 via restrictor means 144' and 146'. upon actuation of the fast travel valve 86 an on-off valve 150' is pilot operated to open and so causes the pressurized air to bypass the restrictor means 144'.

While the embodiment of the invention herein disclosed is believed to be the most practical and preferred, it is recognized that departures may be made therefrom to conform to system requirements or design preferences within the scope of the invention.

What is claimed is:

1. A hydropneumatic control system for a bolster capable of travelling along a first track into and out of a press and along a second track right-angularly crossing the first track, the bolster being of the type including a body having first and second sets of wheels for travelling along the first and second tracks respectively, either of the first and second sets of wheels being mounted to the bolster body via hydraulic lift jack means for up-and-down movement into and out of engagement with the tracks, and a positioning pin normally held in a raised position on the bolster body and moved down to a depressed position at the intersection of the first and second tracks in order to position the bolster thereon, the hydropneumatic control system comprising:

(a) a source of air under pressure;

(b) a first pneumatic motor coupled in driving relationship to at least some of the first set of wheels for moving the bolster back and forth along the first track;

(c) a second pneumatic motor coupled in driving relationship to at least some of the second set of wheels for moving the bolster back and forth along the second track;

(d) first and second pilot-operated selector valves for controlling communication between the pressurized air source and the first pneumatic motor and between the pressurized air source and the second pneumatic motor, respectively;

(e) a source of hydraulic fluid under pressure;

(f) a third pilot-operated selector valve for controlling communication between the pressurized hydraulic fluid source and the hydraulic lift jack means;

(g) control valve means actuated manually for producing pneumatic signals for pilot-operating the first, second and third selector valves;

(h) sensor means actuated automatically for producing pneumatic signals indicative of whether the bolster lies in position in the press nor not, whether the hydraulic lift jack means are extended or contracted, and whether the positioning pin is in the raised or depressed position;

(i) signal processing means responsive to the pneumatic output signals of the control valve means and the sensor means for allowing the output signals of the control valve means to actuate the first, second and third selector valves only when the control valve means are operated properly; and (j) indicator means for indicating the operating conditions of the bolster in response to at least the pneumatic output signals of the sensor means.

2. The hydropneumatic bolster control system as recited in claim 1, wherein the control valve means are disposed external to the bolster and communicated with pertinent parts of the system on the bolster via flexible conduits.

3. The hydropneumatic bolster control system as recited in claim 1, wherein the sensor means comprise:

(a) a bolster position sensor actuted when the bolster lies in position in the press;

(b) at least one extend sensor actuated by the hydraulic lift jack means upon extension thereof;

(c) at least one contract sensor actuated by the hydraulic lift jack means upon contraction thereof;

(d) ann "up" sensor actuated by the positioning pin when the latter is in the raised position; and (e) a "down" sensor actuated by the positioning pin when the latter is in the depressed position at the intersection of the first and second tracks.

4. The hydropneumatic bolster control system as recited in claim 3, wherein the indicator means comprise:

(a) a wheel-change indicator associated with the bolster position sensor and the "down" sensor for making an indication when the lift jack means can be extended or contracted for a changeover from either of the first and second sets of wheels to the other;

(b) a travel indicator associated with the "up" sensor for making an indication when the bolster can be moved along the first or second track;

(c) an extend indicator associated with the extend sensor for making an indication upon extension of the lift jack means; and (d) a contract indicator associated with the contract sensor for making an indication upon contraction of the lift jack means.

5. The hydropneumatic bolster control system as recited in claim 3, wherein the first set of wheels are mounted to the bolster body via the hydraulic lift jack means for movement into engagement with the first track upon extension thereof, and wherein the signal processing means are adapted to allow the first selector valve to be pilot-operated from the control valve means only when the extend sensor and the "up" sensor are both actuated.

6. The hydropneumatic bolster control system as recited in claim 3, wherein the first set of wheels are mounted to the bolster body via the hydraulic lift jack means for movement into engagement with the first track upon extension thereof, and wherein the signal processing means are adapted to allow the second selector valve to be pilot-operated from the control valve means only when the contract sensor and the "up" sensor are both actuated.

7. The hydropneumatic bolster control system as recited in claim 3, wherein the signal processing means are adapted to allow the third selector valve to be pilot-operated from the control valve means only when either of the bolster position sensor and the "down" sensor is actuated.

8. The hydropneumatic bolster control system as recited in claim 1, wherein the signal processing means include logic devices.

9. The hydropneumatic bolster control system as recited in claim 1, wherein the pressurized hydraulic fluid source is driven by the pressurized air source.

* * * * *